United States Patent [19]

Simon

[11] 3,973,919

[45] Aug. 10, 1976

[54] STRIP FOR SPRINGY CONTACTS

[76] Inventor: Hans Simon, Bruchhausener Strasse, 5463 Unkel, Rhine, Germany

[22] Filed: Jan. 9, 1975

[21] Appl. No.: 539,633

Related U.S. Application Data

[62] Division of Ser. No. 347,569, April 3, 1973, Pat. No. 3,874,769.

[30] Foreign Application Priority Data

Apr. 4, 1972 Germany ..... 2216174

[52] U.S. Cl. ..... 29/193.5; 339/176 MP; 339/217 S; 339/258 R

[51] Int. Cl.[2] ..... H01R 9/08

[58] Field of Search ..... 29/193.5; 339/258 R, 339/176 MP, 217 S

[56] References Cited

UNITED STATES PATENTS

| | | | |
|---|---|---|---|
| 2,748,452 | 6/1956 | Pierce | 29/193.5 X |
| 2,944,330 | 7/1960 | Swilic | 29/193.5 |
| 3,516,157 | 6/1970 | Brown | 29/193.5 UX |
| 3,601,775 | 8/1971 | Longenecker et al. | 339/176 MP |
| 3,665,378 | 5/1972 | Hammell et al. | 339/217 S |
| 3,706,960 | 12/1972 | Grenda | 339/258 R |
| 3,713,079 | 1/1973 | Dechelette | 339/258 R |

*Primary Examiner*—Arthur J. Steiner
*Attorney, Agent, or Firm*—Steinberg & Blake

[57] ABSTRACT

A punched strip of electrically conductive sheet material from which a plurality of springy contacts can be cut. These springy contacts each include along the strip a portion for forming a claw to engage insulation around a conductor with the latter portion being followed by a portion for forming a claw to engage the conductor itself. This latter portion is then followed by a base portion which terminates in an end region, and between the latter end region and the portion to form the conductor-engaging claw, the base portion has a pair of elongated portions for forming springy contact arms. The pair of elongated portions diverge and define between themselves where they are located closest to each other a space in which the end region of the base portion is located while where the pair of elongated portions are most distant from each other they define between themselves a space which receives at least that portion of the next contact which will form an insulation-engaging claw for the next contact.

6 Claims, 9 Drawing Figures

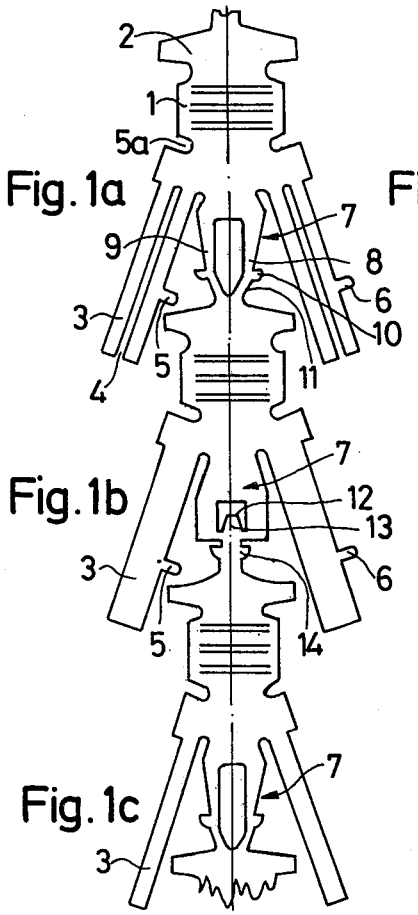
Fig. 1a
Fig. 1b
Fig. 1c
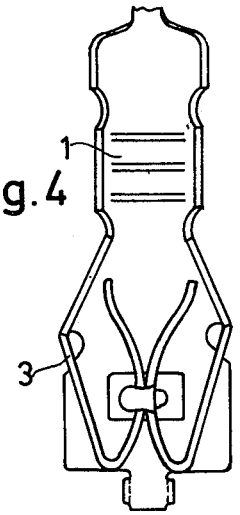
Fig. 4
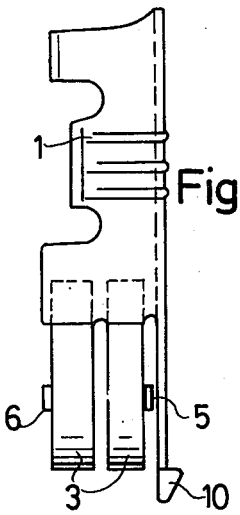
Fig. 5
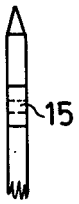
Fig. 6
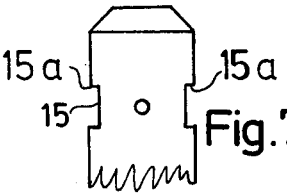
Fig. 7
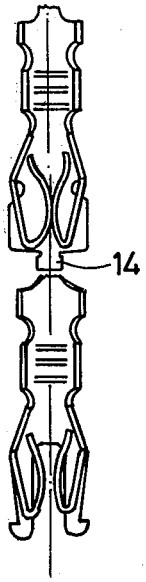
Fig. 2
Fig. 3

STRIP FOR SPRINGY CONTACTS

CROSS REFERENCE TO RELATED APPLICATION

The present application is a division of copending application Ser. No. 347,569, filed Apr. 3, 1973, and entitled SPRING CONTACT FOR ESTABLISHING ELECTRICAL PLUG-IN CONNECTIONS, now U.S. Pat. No. 3,874,769.

BACKGROUND OF THE INVENTION

The present invention relates to spring contacts capable of establishing electrical plug-in connections.

In particular, the present invention relates to an elongated strip which is punched so as to have a configuration according to which a series of spring contacts of the above type can be cut from the strip.

One of the problems encountered with conventional strips of this type is that the series of flat sections which are cut from the strip cannot be conveniently bent to the desired configuration.

A further problem which is encountered is that an exceedingly large amount of waste is encountered with such strips inasmuch as the portions of the strip which are situated between parts of the several springy contact blanks of the strip are for the most part wasted.

SUMMARY OF THE INVENTION

It is accordingly a primary object of the present invention to provide a strip of the above general type which will avoid the drawbacks of the conventional strips of this type.

Thus, it is one of the important objects of the present invention to provide for a strip of the above type a configuration according to which it is possible to easily and effectively bend from sections cut from the strip parts which will readily form the components of the spring contact.

Furthermore it is an object of the present invention to provide a strip of this type which will effect a considerable economy in the material of the strip by minimizing the waste thereof.

According to the invention the punched strip of electrically conductive sheet material from which a plurality of springy contacts can be cut includes for each of the springy contacts, along the strip, a portion for forming a claw to engage insulation, with the latter portion being followed by a portion for forming a claw to engage the conductor which is surrounded by the insulation. This latter conductor-engaging portion is followed by a base portion which terminates in an end region, and between this end region and the portion which is to engage the conductor the base has a pair of elongated portions which are to form springy contact arms. This pair of elongated portions diverge and define where they are located relatively close to each other a space in which the end region of the base portion is located while where the elongated portions are most distant from each other they define between themselves a space to receive at least that portion of the next contact which will form an insulation-engaging claw for the next contact. As a result of this latter feature it is possible to effect a considerable saving in the sheet material of the strip.

BRIEF DESCRIPTION OF DRAWINGS

The invention is illustrated by way of example in the accompanying drawings which form part of this application and in which:

FIGS. 1*a*,1*b*,1*c* illustrate three different types of contact blanks which form successive portions of a punched strip;

FIGS. 2 and 3 respectively illustrate springy contacts formed from the blanks of FIGS. 1*b* and 1*c;*

FIGS. 4 and 5 are respectively elevation and side views of a springy contact formed from the blank of FIG. 1*a;* and FIGS. 6 and 7 are respectively fragmentary edge and elevation views of a plug capable of being used with the springy contact of FIGS. 4 and 5.

DESCRIPTION OF PREFERRED EMBODIMENTS

FIGS. 1*a*, 1*b*, and 1*c* illustrate side projections as are obtained in the manufacture of spring contacts from metal strips. For a better explanation, different modifications of said side projections have been shown, although on the other hand, though not necessarily, always the same profiles are arranged on such a profile strip which can be processed in an automat.

In FIG. 1*a*, the illustrated elongated strip body includes the so-called conductor claw 1 the two sides of which are later, during the deforming step, bent upward whereby it becomes the conductor claw into which the end of the copper wire of the electric lead is inserted, and by deforming the tightening of said conductor claw is connected with the spring contact. Said conductor claw 1 is linked, in one direction, to a so-called insulation claw 2 which upon tightening grips the insulation of the electric wire and holds it in a manner known per se.

As concerns the other direction, there are provided outwardly directed relatively long spring arms 3, shaped in FIG. 1a as double spring arms by recess 4 arranged in longitudinal direction. Between conductor claw and spring arm, there is provided a cut, or a recess, 5a serving to facilitate the bending from the punched portion plane. Spring arms 3 are provided with lateral projections 5 and 6 which, when rectangularly bent, serve for locking the flat plug-in tongues. In view of the oblique position of the spring arms it is possible to locate them along the holding portion (conductor claw and insulation claw) of the following spring contact so that no essential additional material consumption for the shaping of the relatively long spring arms is necessary.

Holding portion 7 is subdivided by a recess in the axial direction into two legs 8 and 9 provided at their ends with a support nose 10 each. At the same time, said holding portion 7 serves as a connection to the following spring contact, where an intermediate link 11, not necessary for the spring contact itself, is provided. By so linking the individual spring contacts it is possible to roll them up in the form of strips which can then be passed on to automats for further processing. Upon further processing, the linking bars which are not necessary for the contacts are cut away or punched out when the electric wire is pressed in.

The punched out portion shown in FIG. 1*b* shows spring arms 3 having no recess in the longitudinal direction. Furtheron, holding portion 7, too, is not subdivided in the axial direction so that there are no legs 8,9. Instead, there is either a free cut 12 forming the known blocking zone 13, and/or there is provided a projection 14 showing on both sides outwardly directed support noses which are bent downwardly at right angles. In FIG. 1*c*, there is shown a further modification of said spring contact wherein spring arms 3 are shaped small so that a relatively flat spring contact can be obtained therewith. Holding portion 7 is again provided with an axial recess, and at the ends of the legs so formed support noses are provided.

All the modifications of the inventive spring contacts have been linked with one another and hence can, when processed, be passed to the tightening tool in the same way, can be separated with one and the same cutting tool, and can be pressed in with one and the same tool.

As has already been mentioned, spring arms 3 are bent from the punched portion plane around their inner longitudinal edge and bent upwardly at an angle of 90° relative to the punched portion plane. Before or thereafter, the spring arms are bent in the direction to their base piece, or to the conductor claw, respectively, so that a spring contact as illustrated in FIGS. 2 and 3 is obtained. In the modifications according to FIGS. 1*b* and 2 there are two fastening hooks 14 each in front of the head or plug-in side of the spring contact. They do not interfere with the contact arms and they are expressively provided outside the conductive cross section. By the arrangement of the holding hooks as shown, the production of insulated housings for this kind of inventive spring contacts has essentially been simplified and reduced in costs.

The punched out portion shown in FIG. 1*c* and the spring contact according to FIG. 3 appertaining thereto are characterized in a very flat construction of said spring contact and are therefore particularly suited for mounting on printed wiring boards, printed circuits, card foils or conductor foils, respectively. The axial recess in the holding portion by which legs 8,9 are formed provides for the space for the mounting or the plug-in side, for instance of a printed wiring board, to be inserted when using the completed spring contact. At the same time, said legs 8,9 limit the play of the board inserted and thus prevent the contact springs from too high a mechanical load.

FIG. 4 constitutes an enlarged top view of a spring contact according to the invention.

FIG. 5 shows a side view of the same spring contact. It includes four spring contact pairs 3 and corresponds to the punched out portion according to FIG. 1*a*. This spring contact is meant for the use in flat plug-in tongues. With the aid of said spring contact, also individual trailing plug-in connections can be obtained. Lateral projections 5 and 6 at the spring arms serve for arresting the plugged-in spring tongue according to FIGS. 6 and 7. The two spring clips 3 are pulled apart by the bevelled flat plug-in tongue and the bent projections of the spring arms engage with the recesses 15 of the flat plug-in tongue. By beveling edge 15*a* in recesses 15 of the flat plug-in tongue, it is possible to essentially simplify the withdrawal of the flat plug-in tongue.

What is claimed is:

1. A punched strip of electrically conductive sheet material from which a plurality of springy contacts can be cut, said springy contacts being arranged successively one after the other along said strip, and said strip comprising an elongated strip body having for each springy contact along said strip a first portion for forming a claw to engage insulation around a conductor, a second portion following said first portion for forming a claw to engage a conductor, and a base portion following said second portion and terminating in an end region, and said base portion having between said end region and said second portion which forms the claw to engage the conductor a pair of elongated portions for forming springy contact arms, said pair of elongated portions diverging away from said second portion of said strip body and defining between themselves where they are located closest to each other a space in which said end region is located and said pair of elongated portions defining between themselves where they are most distant from each other a given space, and at least that portion of the next contact which will form an insulation-engaging claw for the next contact being situated in said given space.

2. The combination of claim 1 and wherein said end region has the configuration of a hook means.

3. The combination of claim 1 and wherein said strip body is formed between each portion which is to form a conductor-engaging claw and said base portion with a pair of opposed notches at opposed side edges of the strip body, said notches respectively being situated at ends of said pair of elongated portions to facilitate bending thereof.

4. The combination of claim 1 and wherein said pair of elongated portions are each of substantially rectangular configuration.

5. The combination of claim 4 and wherein a pair of projections respectively extend from a pair of edges of said elongated portions.

6. The combination of claim 1 and wherein each of said pair of elongated portions is formed with a slit extending through each elongated portion from one end thereof so as to define on opposite sides of said slit a pair of contact arm portions.

* * * * *